US006227792B1

(12) United States Patent
Baker et al.

(10) Patent No.: US 6,227,792 B1
(45) **Date of Patent: *May 8, 2001**

(54) VERTICAL ENGAGEMENT HYDRAULIC TOOL COUPLER

(75) Inventors: Sherrie R. Baker, Sanford; Matthew P. Burr, Apex; Jeffrey A. Deneve, Sanford; Owen S. Loughrin, Sanford; Charles T. McMillan, Sanford; Kevin J. Romanchok, Holly Springs, all of NC (US)

(73) Assignee: Caterpillar S.A.R.L., Geneva (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/962,499

(22) Filed: Oct. 31, 1997

Related U.S. Application Data

(60) Provisional application No. 60/051,318, filed on Jun. 30, 1997.

(51) Int. Cl.[7] ..... E02F 3/00
(52) U.S. Cl. ..... 414/723; 37/468
(58) Field of Search ..... 414/723; 37/468; 403/324

(56) References Cited

U.S. PATENT DOCUMENTS

| | | | | |
|---|---|---|---|---|
| 3,705,656 | * | 12/1972 | Hunger et al. | 414/723 |
| 3,794,195 | | 2/1974 | Clevenger et al. | 214/145 |
| 4,480,955 | | 11/1984 | Andrews et al. | 414/723 |
| 4,643,631 | | 2/1987 | Maurer et al. | 414/723 |
| 4,812,103 | | 3/1989 | Cochran et al. | 414/723 |
| 4,813,163 | * | 3/1989 | Livingston et al. | 414/723 X |
| 4,890,974 | * | 1/1990 | Kistner | 414/723 |
| 4,944,628 | | 7/1990 | Hulden | 403/24 |
| 4,963,071 | | 10/1990 | Larwin et al. | 414/723 |
| 4,984,957 | | 1/1991 | Noguchi et al. | 414/723 |
| 4,984,958 | * | 1/1991 | Kaczmarzyk | 414/723 |
| 5,107,610 | * | 4/1992 | Fusco | 414/723 X |
| 5,400,531 | | 3/1995 | Brown | 37/468 |
| 5,403,144 | * | 4/1995 | Staben, Jr. | 414/723 X |
| 5,494,396 | * | 2/1996 | Geier et al. | 414/723 |
| 5,692,852 | * | 12/1997 | Collins | 414/723 X |
| 5,692,855 | * | 12/1997 | Burton | 414/723 X |

FOREIGN PATENT DOCUMENTS

| | | | |
|---|---|---|---|
| 1456538 | 1/1969 | (DE) | 81/87 |
| 0438931 | 7/1991 | (EP) | E02F/3/40 |
| 2087349 | 5/1982 | (GB) | E02F/3/81 |
| 2195610 | 4/1988 | (GB) | E02F/3/80 |
| 83/03629 | 10/1983 | (WO) | E02F/3/96 |
| 8202731 | 8/1992 | (WO) | E02F/3/96 |

OTHER PUBLICATIONS

Rylind—Wedge Lock Coupler Systems 1 Page.
Verachtert—Schnellwechsel–einrichtung System 2000 Publication—5 pages.

* cited by examiner

*Primary Examiner*—Donald W. Underwood
(74) *Attorney, Agent, or Firm*—Diana L. Charlton

(57) ABSTRACT

In the operation of a construction machine, such as a wheel loader, it is essential to provide load distribution capabilities for improved strength characteristics in the components. Additionally, high visibility is required for an operator to view a work implement during normal operation or coupling. The present invention includes a hydraulic coupler utilizing a pair of separate coupler assemblies which are connected at opposing ends of an upper and lower coupler pin boss at a pair of pin joints including a pair of pins to define a spatial relationship therebetween. The pins each have a cylindrical central portion and rectangular shaped end portions which are fixed within rectangular shaped pin mounting openings in first and second end portions of the coupler assemblies. The separation of the coupler assemblies provides enhanced visibility for an operator. The utilization of the pins as structural members distributes loading in a substantially straight path from the work implement to the machine decreasing the load burden on components, such as the hydraulic coupler.

26 Claims, 11 Drawing Sheets

VERTICAL ENGAGEMENT HYDRAULIC TOOL COUPLER

CROSS REFERENCE TO RELATED APPLICATIONS

This application is based, in part, on the material disclosed in U.S. provisional patent application Ser. No. 60/051,318 filed Jun. 30, 1997 and claims benefit thereof.

TECHNICAL FIELD

This invention relates generally to a quick release and attachment assembly for construction machines and more particularly to a vertically engaged hydraulic coupler for connecting a work implement to the construction machine.

BACKGROUND ART

Present construction machines, such as wheel loaders, typically may incorporate manual or hydraulic couplers to release and attach various work implements or tools during normal daily operation. The task of releasing the tools from the machine and attaching a different tool may be difficult and time consuming, especially in the field.

During the alignment between a hydraulic coupler and the tool prior to connection, an operator generally must visually judge where to manipulate the machine in order to facilitate the alignment. During this alignment phase, visibility may be hampered due to the structure and design of typical hydraulic couplers and linkage structures. Additionally, hydraulic couplers are usually designed to withstand loads from the tool which occur during normal operation. The direction of loads through the hydraulic coupler may diminish even distribution of loading from the work implement to the machine and may cause failure to the implement, hydraulic coupler components or supporting structure.

A design disclosed in U.S. Pat. No. 4,480,955 issued to Errol F. Andrews et al. on Nov. 6, 1984 utilizes a quick release and attachment coupling for operating tools. This design includes a head with a pair of spaced side plates connected together by a base plate and is pivotally mounted on a boom of a machine. Visibility from the machine to the coupling is hampered by the positioning of the base plate and the overall design of the quick release and attachment coupling. Additionally, a majority of loading is incurred at the coupling itself, thus forcing the coupling plates to have additional thickness for strength compensation, increasing the weight of the coupling and decreasing the overall performance of the machine.

The present invention is directed to overcoming the problems as set forth above.

DISCLOSURE OF THE INVENTION

In one aspect of the present invention, a quick release and attachment assembly for coupling a work implement to a construction machine is disclosed. The construction machine has a frame and a box boom lift arm assembly pivotally connected to the frame at a first end. A lower coupler pin boss is fixedly connected at a second end of the box boom lift arm assembly opposite the first end. A tilt linkage arrangement is pivotally connected at a first end to the box boom lift arm with an upper coupler pin boss fixedly connected at an second end opposite the first end. A first attachment means is connected to the work implement and includes a base. A pair of opposed connecting plates and a pair of opposed locating plates are fixedly connected to the base. Each one of the pair of locating plates is positioned substantially perpendicular to and in abutment with respective first and second ends of each of the pair of connecting plates. A second attachment means includes a body portion and a pair of vertical plates connected to the body portion in a spaced relationship. The body portion has an engagement portion adjacent the base and a pair of opposing side projections extending from the engagement portion in a predetermined relationship with the pair of locating plates of the first attachment means. Engagement means is disposed within the body portion for movement between a first position for connecting the first and second attachment means and a second position for releasing the first and second attachment means. Means for connecting the second attachment means to the upper and lower coupler pin bosses includes a pair of pins. Each of the pair of pins is releasably connected to the pair of vertical plates at first and second end portions thereof for allowing movement of the second attachment means correspondent to the respective movement of the tilt linkage arrangement and the box boom lift arm assembly.

In another aspect of the present invention, a quick release and attachment assembly for coupling a work implement to a construction machine at remote ends of a first member with a lower coupler pin boss and a second member with an upper coupler pin boss is disclosed. Each of a pair of coupler assemblies is adapted for connection with respective first and second ends of the upper and lower coupler pin bosses to define a spatial relationship therebetween.

In yet another aspect of the present invention, a quick release and attachment assembly for coupling a work implement to a construction machine at remote ends of a first member with a lower coupler pin boss and a second member with an upper coupler pin boss is disclosed. A first attachment means is connected to the work implement and includes an attaching portion connected thereto. A second attachment means is releasably connected to the first attachment means at the attaching portion. The second attachment means includes a body portion and a pair of vertical plates connected to the body portion in a spaced relationship. The pair of vertical plates each include a pin mounting opening defined at first and second end portions. The pin mounting openings have a substantially rectangular shape and include a clamp portion which extends therefrom and terminates at a pair of spaced flanges which define a coaxial opening therethrough. Means for connecting the second attachment means to the upper and lower coupler pin bosses is disclosed and includes a pair of pins and a bolt assembly. The pair of pins each include a cylindrical central portion which extends through the upper and lower coupler pin bosses and terminates at substantially rectangular end portions fitted within the rectangular shaped openings in each of the pair of vertical plates. The bolt assembly extends through the coaxial openings in each of the spaced flanges for fixing the end portions of the pins within the rectangular shaped openings in each of the pair of vertical plates.

The present invention includes a pair of coupler assemblies which are fixedly connected at first and second end portions to respective first and second ends of upper and lower coupler pin bosses to define a spatial relationship. The spatial relationship between the coupler assemblies increases visibility for an operator during the coupling process. The pair of coupler assemblies are connected to the upper and lower pin bosses through a pair of pins which are uniquely shaped to act as structural members of the coupler assemblies. Therefore, the pins incur a portion of the loads acting upon the machine to improve strength through a more even distribution of loading without increasing the weight of the machine.

BEST MODE FOR CARRYING OUT THE INVENTION

Figure 1:
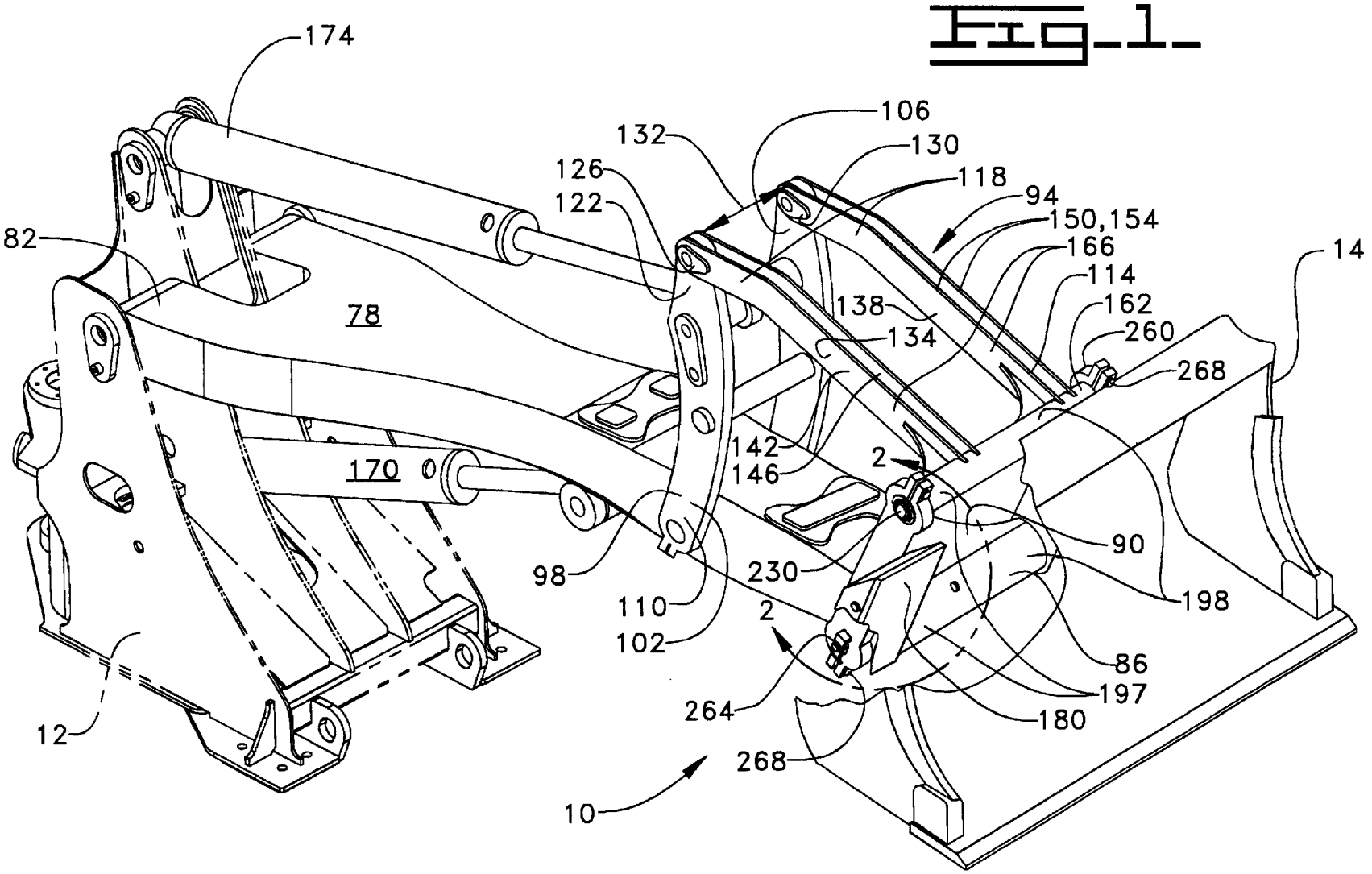
FIG. 1 is a partial, diagrammatic isometric view of a construction machine embodying the present invention connected thereto.
Figure 2:
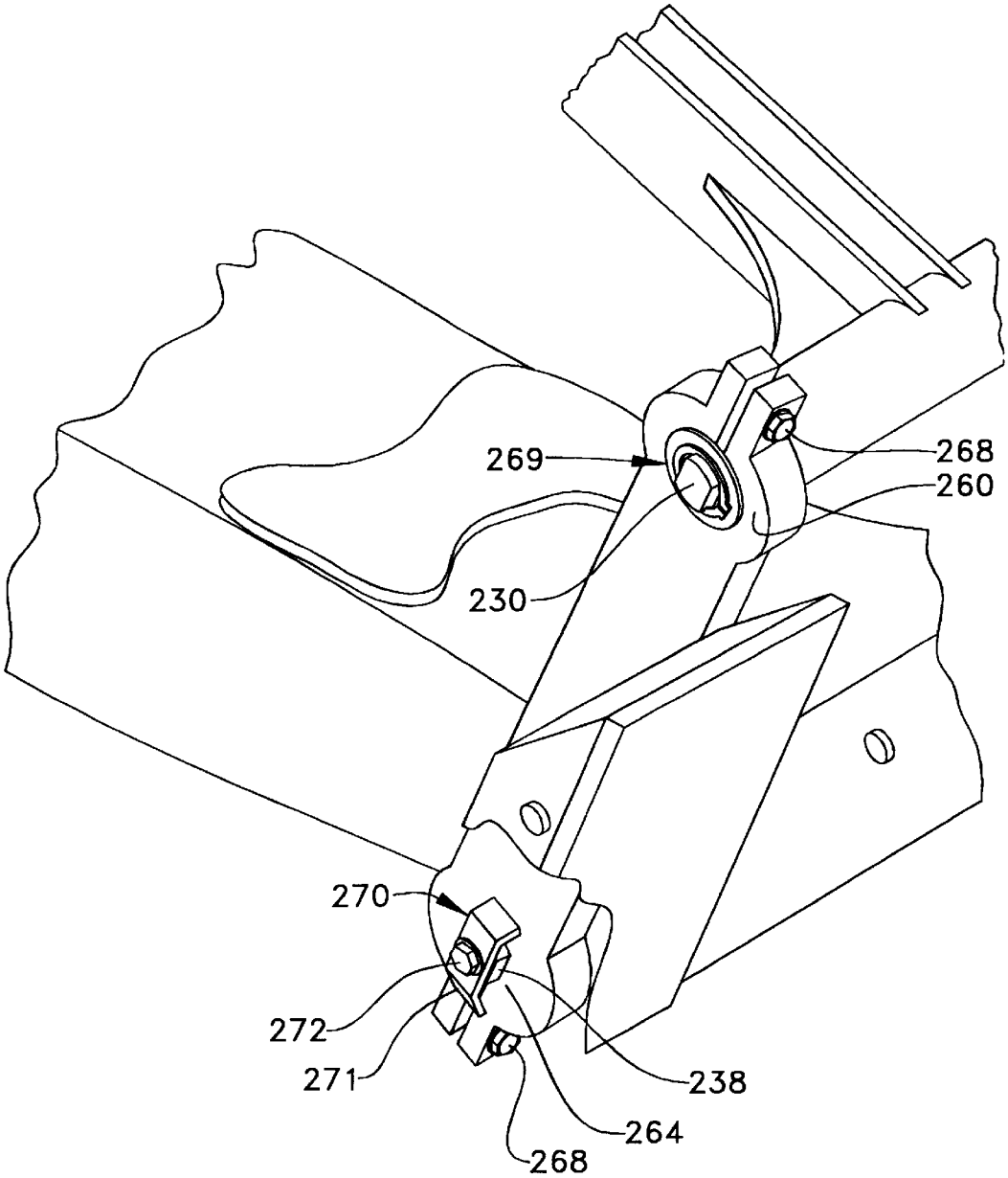
FIG. 2 is an exploded partial view taken along line 2—2 in FIG. 1.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring to the drawings, it can be seen that a quick release and attachment assembly 10 for use on a construction machine 11, such as a wheel loader, is disclosed which couples a work implement or tool to the construction machine 11. A non-engine end frame 12, typical of an articulated wheel loader, is shown in FIG. 1 which is connected to the machine 11 in a well known manner. It should be understood that although the present invention is described in use with an articulated wheel loader that a non-articulated wheel loader could also be utilized. It should also be understood that although the work implement shown in FIGS. 1 and 7–10 are a bucket and forks commonly used in conjunction with a wheel loader that any one of a number of different tools may be used. It should also be understood that the quick release and attachment assembly may be used on any type of construction machine.

Figure 7:
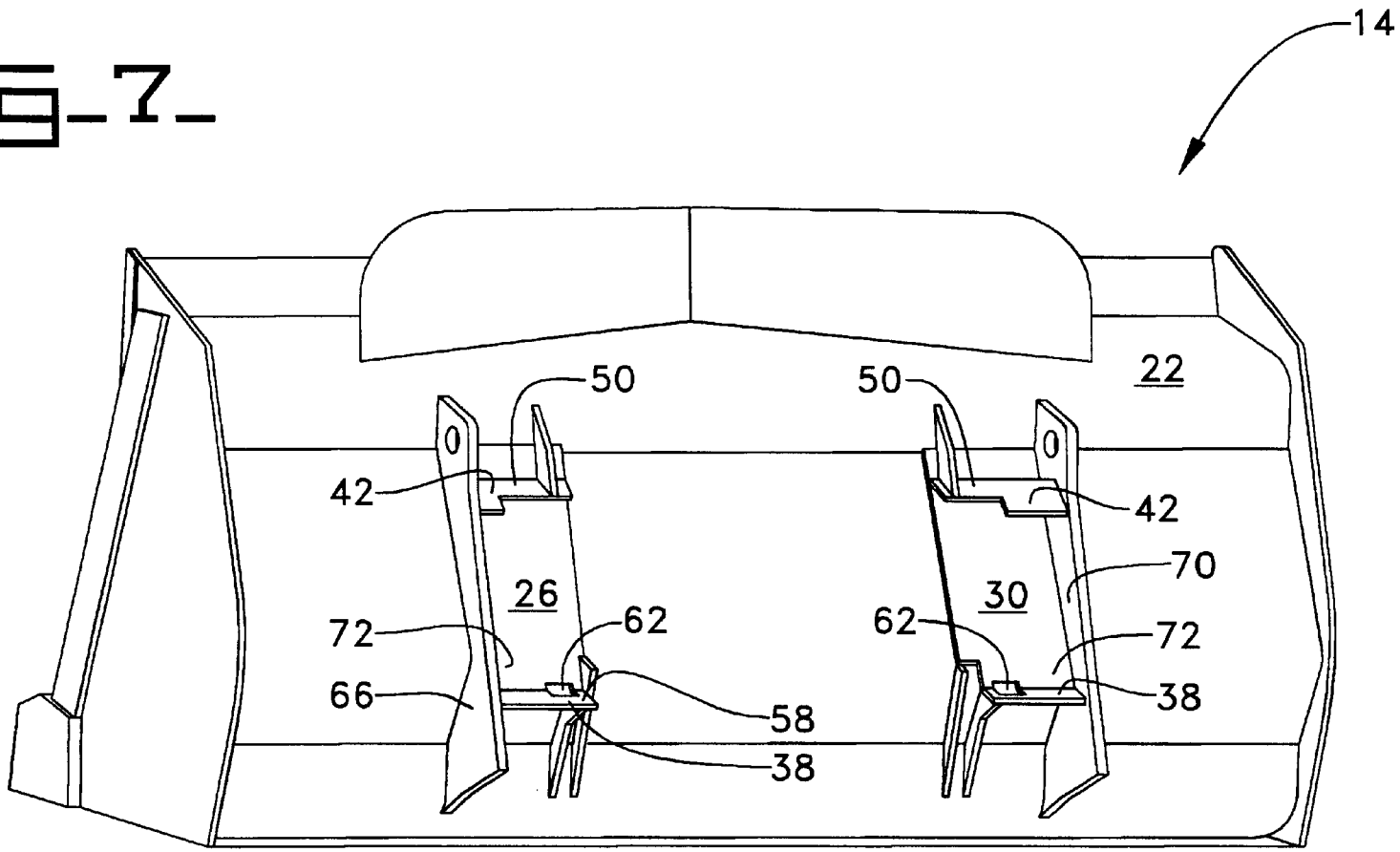
FIG. 7 is a diagrammatic view of a first work implement without the pair of coupler assemblies connected.
Figure 8:
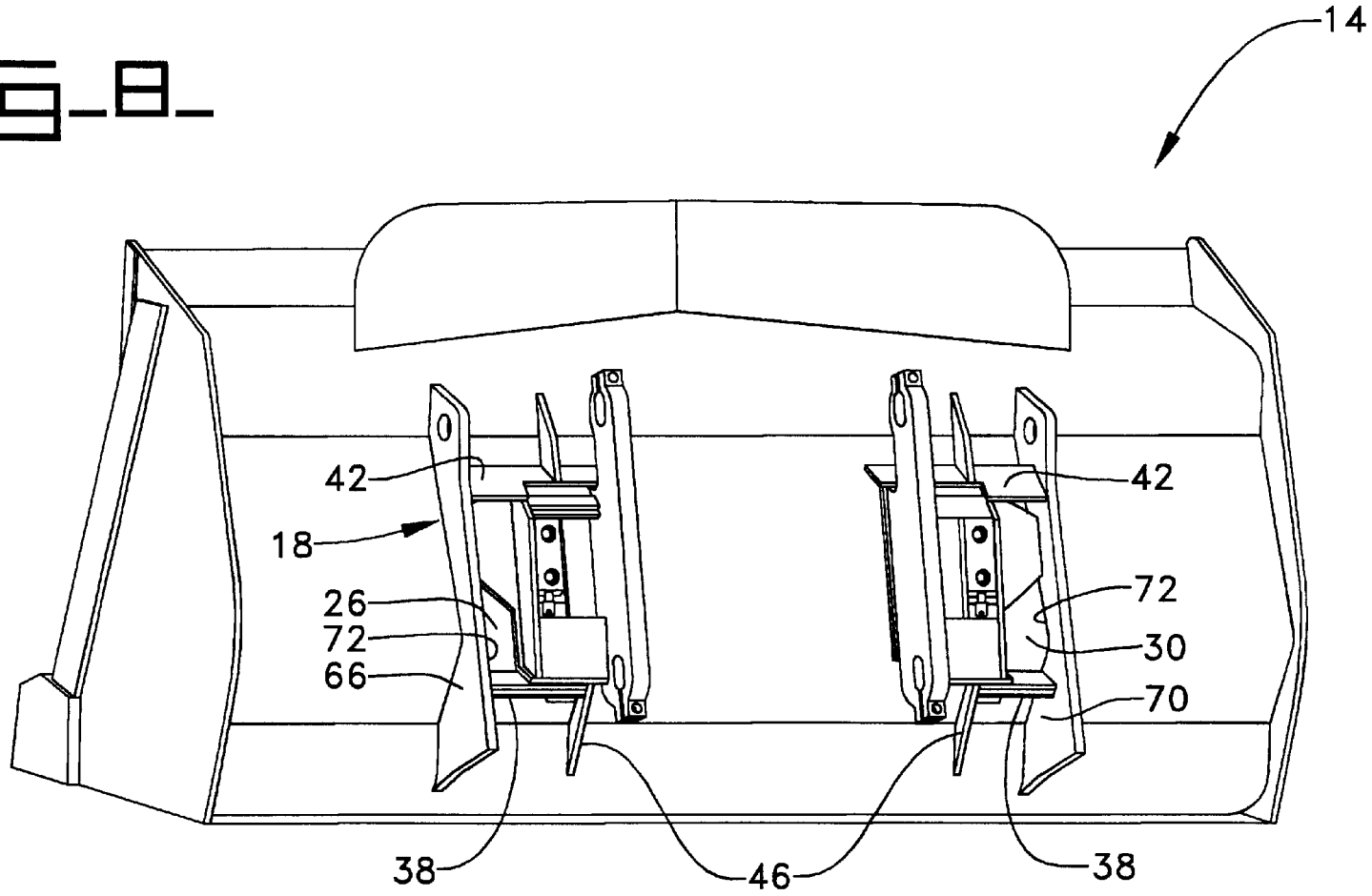
FIG. 8 is a diagrammatic view of the first work implement with the coupler assemblies shown in connection therewith.

The bucket 14, shown more clearly in FIGS. 7 and 8, includes a first attachment means 18 located at a substantially planar portion of a rear wall 22. The first attachment means 18 includes first and second spaced interface plates 26,30 welded to the planar rear wall portion 22 in any suitable manner. Each of the first and second interface plates 26,30 are formed to include a lower plate portion 38. An upper plate 42 which is angled approximately 45 degrees from normal with the rear wall 22 toward the lower plate portion 38 is welded to each of the first and second interface plates 26,30 and is spaced a predetermined distance from the lower plate portion 38. The first and second interface plates 26,30 and the upper plates 42 are further supported in position in any suitable manner, such as through bracing gussets 46. The angled upper plates 42 each have a notched end portion 50 and define first and second mounting ledges 54, respectively. The lower plate portions 38 of the first and second interface plates 26,30 define first and second seating ledges 58, respectively. The first and second seating ledges 58 each include a rectangular aperture 62 therethrough. A pair of locating plates 66,70 are welded to the rear wall 22 at an outer end 72 of a respective first and second interface plates 26,30 and therebetween opposite the notched end portion 50 of the upper plates 42. Each locating plate 66,70 is extends between and substantially perpendicular to the upper plate and lower plate portion 42,38 and abutted thereagainst.

Figure 9:
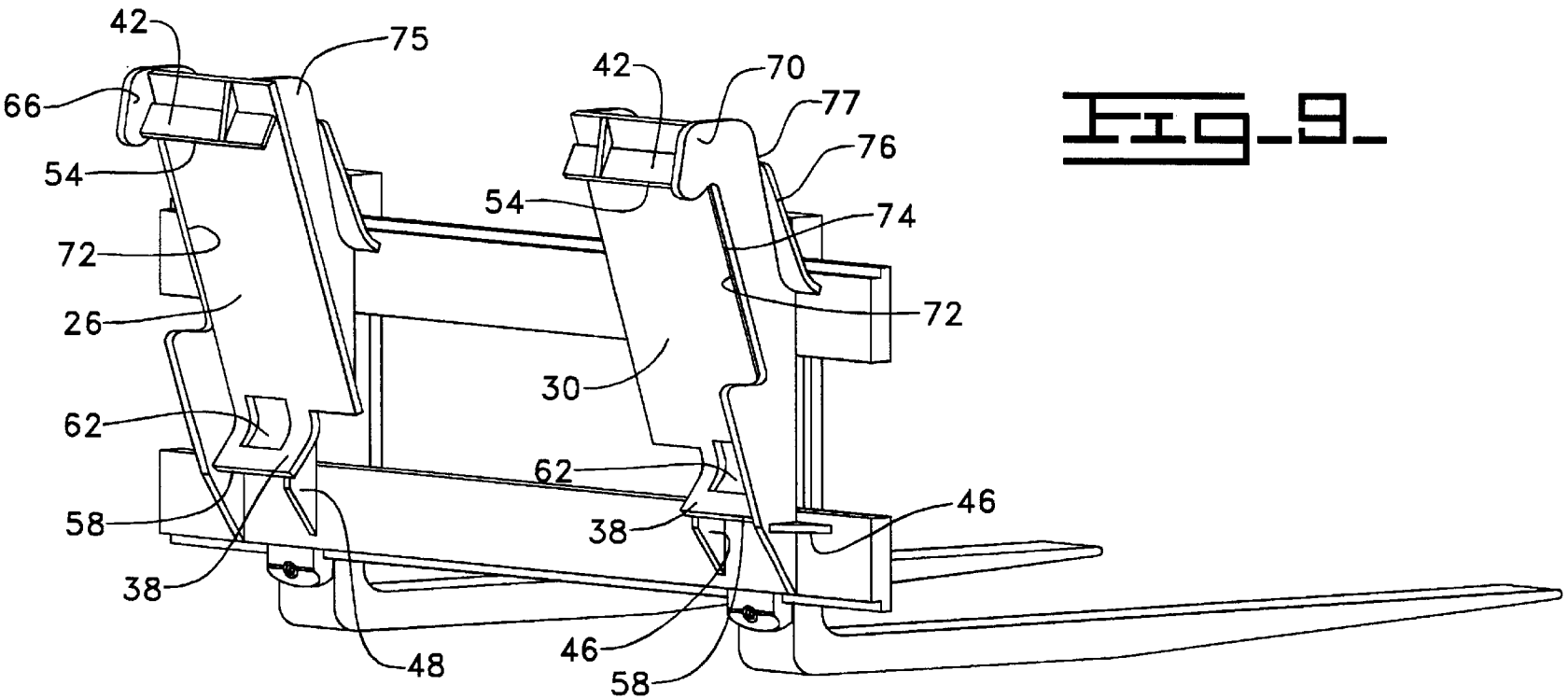
FIG. 9 is a diagrammatic view of a second work implement without the pair of coupler assemblies connected.
Figure 10:
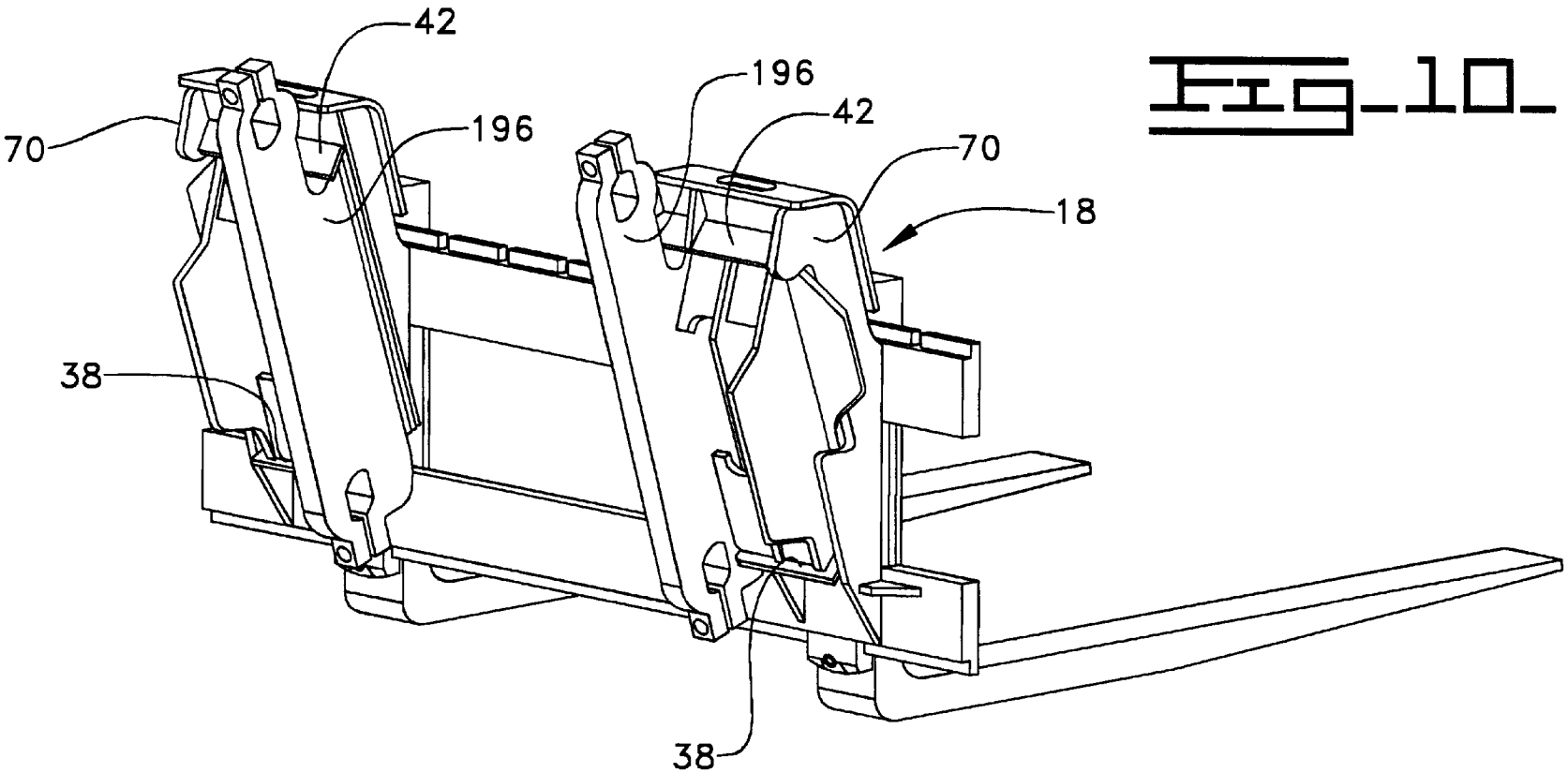
FIG. 10 is a diagrammatic perspective view of the second work implement with the coupler assemblies shown in connection therewith.

The forks, shown more clearly in FIGS. 9 and 10, include similar counterpart features utilizing the same reference numbers as those shown on the bucket in FIGS. 7–8. Each of the pair of locating plates 66,70 includes a notched portion 74. A pair of support plates, one of which is shown at 75, are welded to the rear wall 22 at an end of the first and second interface plates 26,30 opposite the locating plates 66,70. A cover plate 76 is connected to each of the pair of locating plates 66,70 and respective support plates 75 at a rear portion 77 thereof and extends across the width of the respective interface plates 26,30. The upper plates 42 have a continuous width across the length which is non-interrupted as opposed to the bucket upper plates 42. It should be understood that various other tools might have distinct features from those disclosed in FIGS. 7–10 which are inclusively necessary to their proper function with the present invention. It should be understood that any such tool does not depart from the scope of this invention and such features are incorporated herewith.

A box boom lift arm assembly 78 is directly positioned between the frame 12 and the bucket 14 on a vertical plane that is coincident with a centerline defined by the construction machine 11. The box boom lift arm assembly 78 is pivotally connected at a first end portion 82 to the frame 12 in any suitable manner. A lower coupler pin boss 86 with a tubular structure, made from tube steel or fabricated with any other suitable material, is connected at a second diverging end portion 90 opposite the first end portion 82 of the box boom lift arm assembly 78. A tilt linkage arrangement 94 includes a tilt lever 98 with spaced side walls 102,106 which are pivotally connected at a respective first end portion 110 to the box boom lift arm assembly 78 in a well known manner. A tilt link 114 is pivotally connected at a first end portion 118 to a second end portion 122 of the tilt lever 98 at a pair of spaced pin joints 126,130 to define a clearance space 132. The tilt link 114 has a pair of spaced side rails 134,138 with a pair of spaced legs 142,146,150,154, respectively. One of the pair of spaced legs 142,146,150,154 straddle one of the pair of spaced side walls 102,106 of the tilt lever 98. An upper coupler pin boss 162 is welded to the spaced side rails 134,138 at a second end portion 166 of the tilt link 114 and extends therebetween at a length substantially equal to the length of the lower coupler pin boss 86 and greater than the clearance space 132 between the pair of pin joints 126,130. A pair of hydraulic cylinders 170,174 are pivotally connected to the box boom lift arm assembly 78 and tilt linkage arrangement 94, respectively, for controllably lifting and tilting the bucket 14 in a plurality of positions as is well known in the art.

Figure 3:
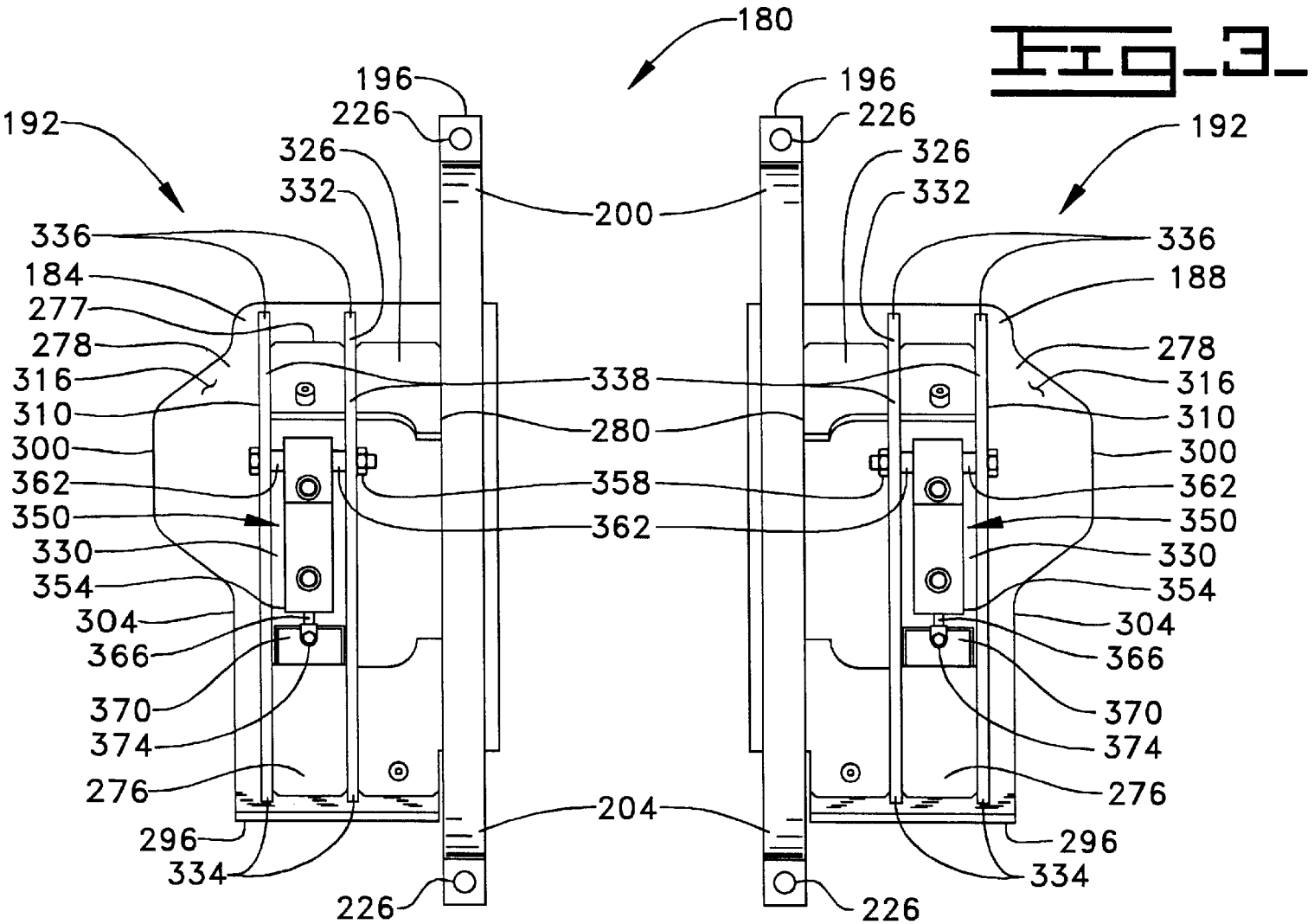
FIG. 3 is an diagrammatic rear view of a pair of coupler assemblies of the present invention shown disconnected from the construction machine.
Figure 4:
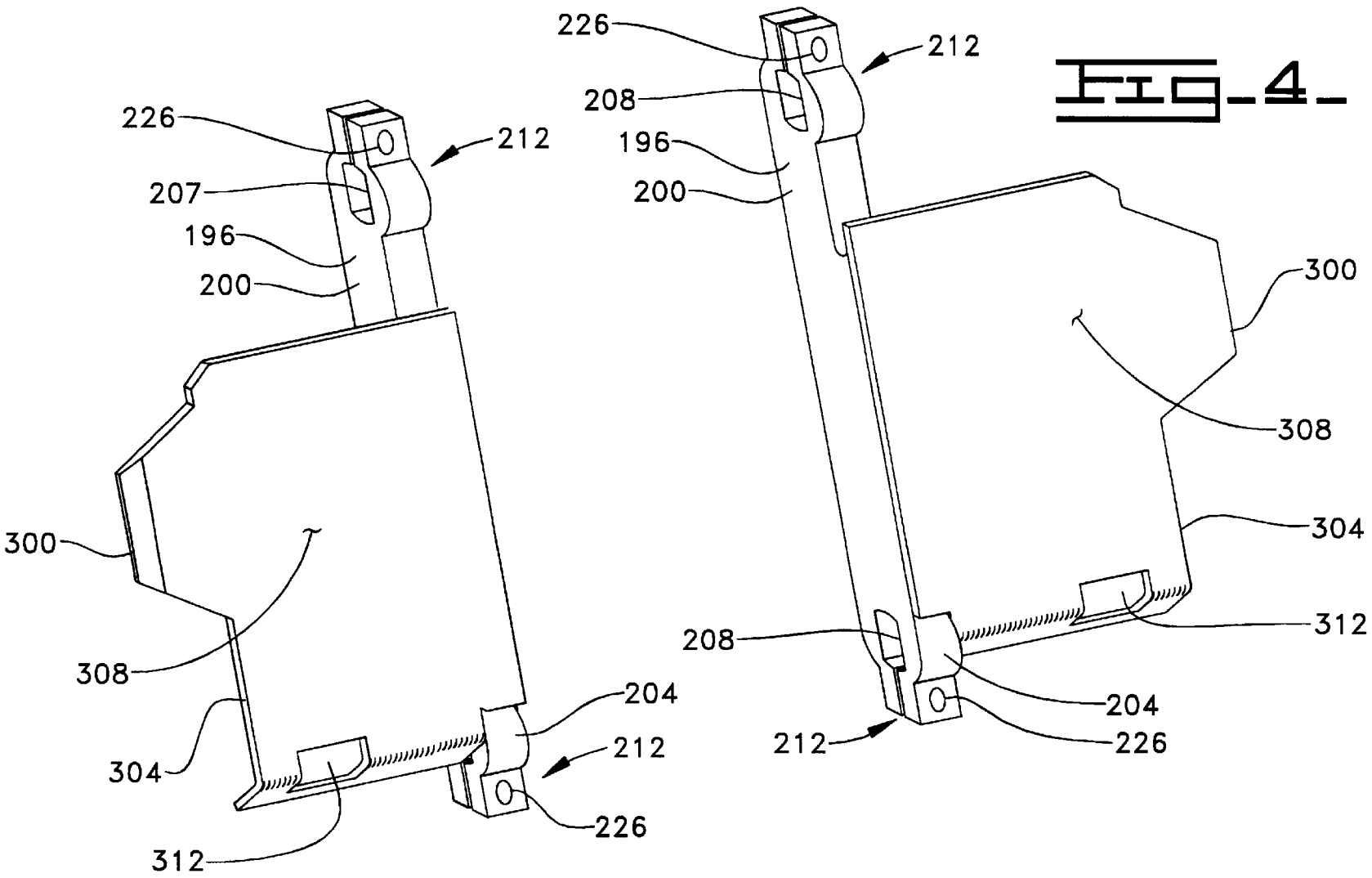
FIG. 4 is a diagrammatic view of the pair of coupler assemblies of the present invention shown in FIG. 2.
Figure 5:
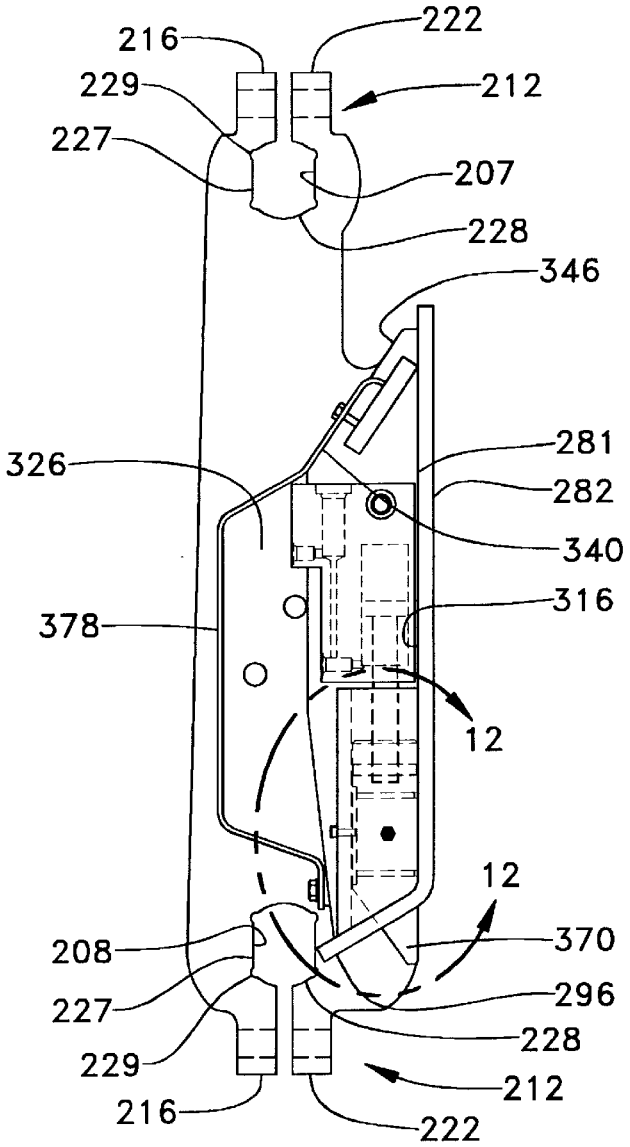
FIG. 5 is a diagrammatic side view of one of the pair of coupler assemblies of the present invention shown in FIG. 2.
Figure 11:
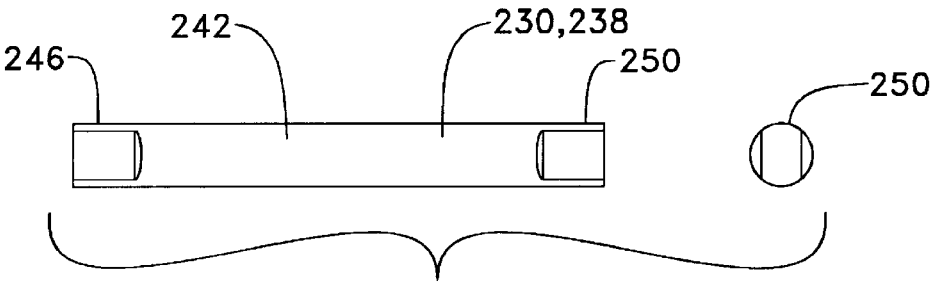
FIG. 11 is a top and side view of a pin used for connecting the pair of coupler assemblies of the present invention to a construction machine.
Figure 6:
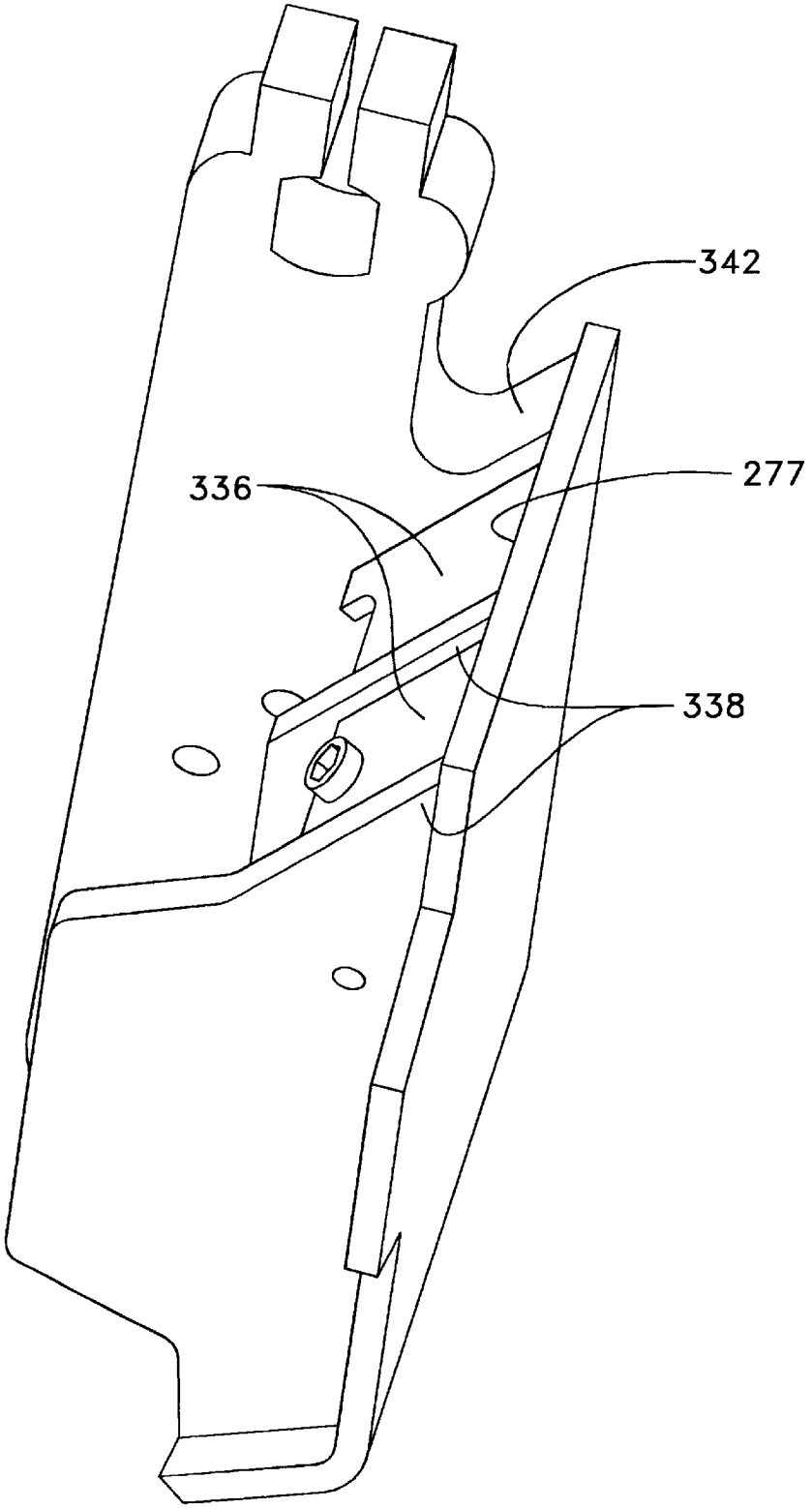
FIG. 6 is a diagrammatic perspective view of one of the pair of coupler assemblies of the present invention shown in FIG. 2.

A second attachment means 180, such as a hydraulic tool coupler, is shown more clearly in FIGS. 3–5 and has a pair of spaced coupler assemblies 184,188 each dimensioned to fit adjacent one of the first and second pair of connecting plate 26,30, respectively, on the first attachment means 18. The coupler assemblies 184,188 each have body portion 192 and a vertical plate portion 196 connected to the body portion 192 in any suitable manner, such as welding or may be made integral therewith. The coupler assemblies 184,188 are located at opposing first and second ends 197,198 of the upper and lower coupler pin bosses 162,86 to define a spatial relationship therebetween. First and second end portions 200,204 of each of the vertical plate portions 196 include first and second pin mounting openings 207,208, respectively. Each of the first and second pin mounting openings 207,208 have a substantially rectangular shape and a clamp portion 212 extending from the pin mounting openings 207,208 and terminating in a pair of spaced flanges 216,222 with a pair of coaxial openings 226 therethrough. The second pin mounting opening 208 is larger than the first pin mounting opening 207. The substantially rectangular shape consists of a pair of planar side walls 227 joined by a pair of arcuate end walls 228. A relief 229 is formed at the intersection between the side and end walls 227,228. A pair of pins 230,238, one of which is shown in FIG. 11, each have a cylindrical central portion 242 and substantially rectangular end portions 246,250 corresponding to the rectangularly shaped pin mounting openings 207,208 in each of the vertical plate portions 196. Each of the rectangular end portions 246,250 include a pair of spaced planar surfaces formed at the end of the cylindrical portion 242. The pair of pins 230,238, shown in FIG. 1, extend through the respective upper and lower coupler pin bosses 162,86 and through the pin mounting openings 207,208 of the vertical plate portions 196 of each of the pair of coupler assemblies 184,188. The cylindrical central portion 242 of the pair of pins 230,238 is disposed within the respective upper and lower coupler pin bosses 162,86 and the rectangular shaped end portions 246,250 are disposed within the rectangular shaped pin mounting openings 207,208 in the vertical plate portions 196 to define a respective pair of pin joints 260,264. It should be understood that the pair of pins 230,238 are identical except that one of the pair of pins 238 is diametrically larger than the other one of the pair of pins 230 for proper fit within the larger pin mounting openings 208. It should also be understood that the pair of pins 230,238 and each of the pin mounting openings 207,208 may be substantially equal in size without exceeding the scope of the invention. A bolt assembly 268 extends through each of the coaxially aligned openings 226 in the spaced flanges 216, 222 of the vertical plate portions 196. The bolt assembly 268 is tightened to clamp the pair of coupler assemblies 184,188 to the pair of pins 230,238 for connection with the tilt link 114 and box boom lift arm assembly 78 and to ensure alignment and synchronized performance of the pair of coupler assemblies 184,188. A snap ring and washer assembly 269 of any suitable type is disposed within a groove (not shown) formed on the rectangular end portions 246,250 of one of the pair of pins 230. A bracket assembly 270 including a bracket 271 of any suitable type is connected on the rectangular end portions 246,250 of the other one of the pair of pins 238 by a bolt 272 extending through an opening (not shown) in the bracket 271 and into a threaded bore (not shown) in the rectangular end portions 246,250.

Each body portion 192 of the coupler assemblies 184,188 includes a housing 276 with a front wall 277 and an engagement plate 278. The vertical plate portions 196 being connected to a respective inner side wall portion 280 of the housings 276 and the engagement plate 278 to define with the housing 276 a planar front wall portion 281. The vertical plate portions 196 being positioned to create a clearance space between the first end portion 200 thereof and the engagement plate 278. The engagement plate 278 includes a front wall portion 282 which extends integrally into a lower wall portion 296 formed substantially at an angle approximately 25 to 35 degrees normal from the front wall portion 282. A tool alignment projection 300 extends from an outermost edge portion 304 of the engagement plate 278 and is integral with the front wall portion 282 to define a planar surface 308. The tool alignment projections 300 are adjacent a respective outer side wall portion 310 of the housings 276 opposite the inner side walls portions 280. The lower wall portion 296 includes a substantially rectangular aperture 312 corresponding in size and shape to the rectangular aperture 62 in the seating ledge 58 of the first and second pair of connecting plates 26,30 of the first attachment means 18. Each of the housings 276 is connected at a front wall portion 277 to a rear wall portion 316 of the engagement plate 278 in any suitable manner, such as welding. Each of the housings 276 include an upper edge portion 326, a central chamber portion 330 with a central wall portion 332 and a lower edge portion 334 seated against the lower wall portion 296 of the engagement plate 278. The upper edge portion 326 has a pair of shelves 336 angled approximately 30 to 40 degrees from normal with the rear wall portion 316 of the engagement plate 278 toward the lower edge portion 334. The shelves 336 are defined by an end extension 338 of the outer side wall portions 310 and the central wall portions 332 beyond the length of the housing 276. Each of the pair of shelves 336 on the upper edge portions 326 of the housings 276 is operatively associated with a respective ledge portion 340 with a similar angularity formed from a lip 342 of each of the vertical plate portions 196 to define a joint tool mounting edge 346.

Figure 12:
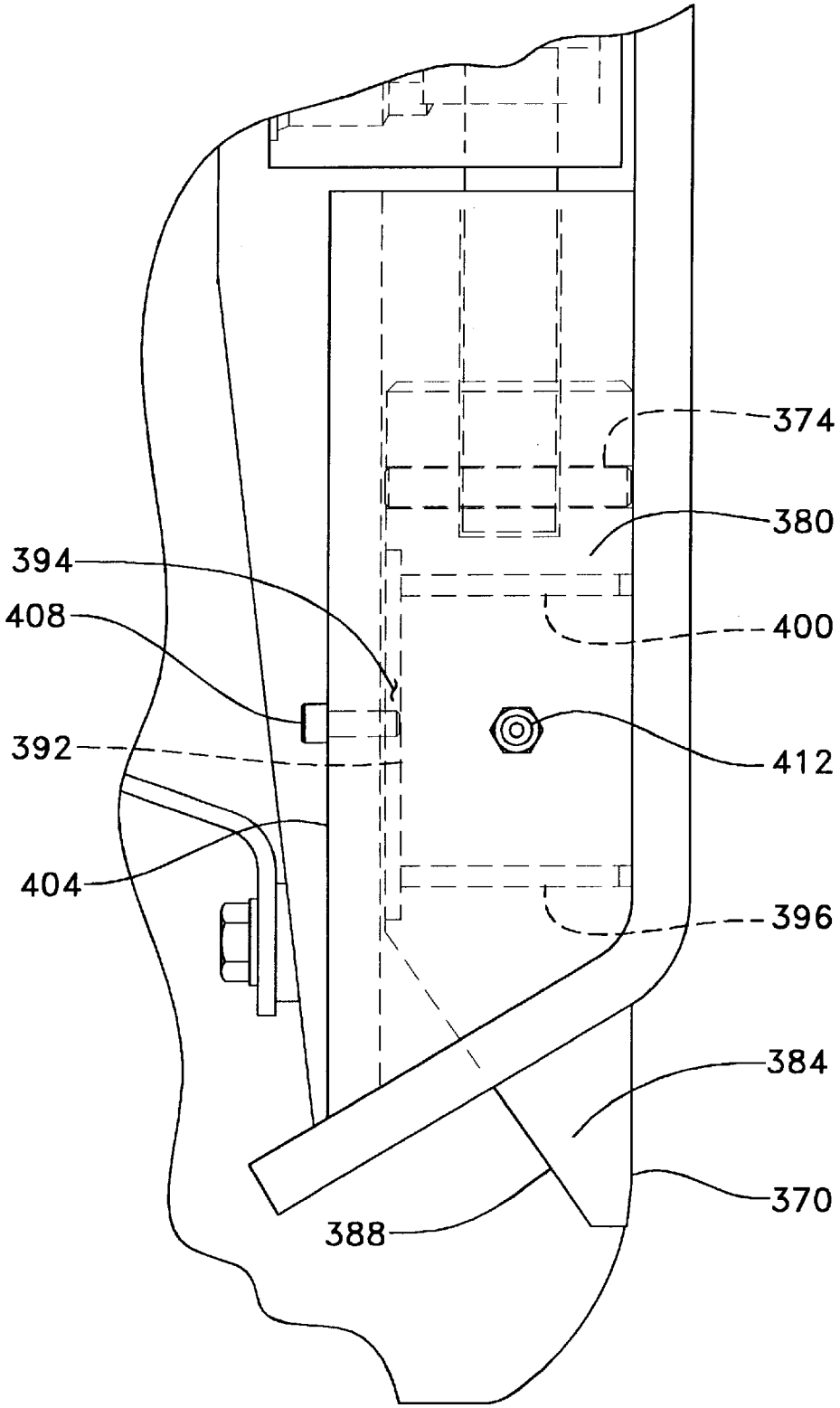
FIG. 12 is a diagrammatic exploded view of the area encircled by line 12—12 in FIG. 5.

A movable hydraulic pin engagement system 350 is disposed within each of the central chamber portions 330 of the housings 276. Each hydraulic pin engagement system 350 includes a hydraulic cylinder 354 of any suitable type which is mounted vertically by a nut and bolt assembly 358 extending through the outer side wall portion 310 and the central wall portion 332 of the housings 276 and horizontally by spacers 362 made from plastic or any suitable material. Each hydraulic cylinder 354 is connected in any suitable manner to a hydraulic system (not shown) of the machine 11. A cylinder rod 366 and hydraulic cylinder seals (not shown) are conventionally mounted within the hydraulic cylinder 354 and operatively associated with the hydraulic system (not shown) for movement between a first and second position. An engagement pin 370 is fitted to the cylinder rod 366 by a solid pin 374 so that it is substantially coaxially aligned with the respective rectangular apertures 312 in the lower wall portions 296 of the engagement plates 278. A cover plate 378 may be used to enclose the hydraulic cylinders 354 within the central chamber portions 330. It should be understood, however, that the cover plate 378 is not required but may be used to protect the hydraulic pin engagement system 350. As can be seen more clearly in FIG. 12, the engagement pin 370 is elongate with a solid tubular shape with upper and lower portions 380,384. A flat surface 388 extends from the upper portion 380 at an angle to define a wedged shape for the lower portion 384. It should be understood that the engagement pin 370 may be rectangular, oval or any suitable overall shape with a wedge shaped lower portion and achieve the same results. A planar recess 392 is formed on the outer surface of the engagement pin 370 at the upper portion 380 thereof and extends substantially therealong to define an anti-rotation region 394 . A pair of spaced oil ring grooves 396,400 extend from the planar recess 392 along the outer periphery of the engagement pin 370. The engagement pin 370 is disposed with a tubular housing 404 and mounted for slidable movement therein. The tubular housing 404 is connected as a structural member to the body portions 192 of the coupler assemblies 184,188. A set screw 408 extends through an opening in the tubular housing 404 and terminates within the anti-rotation region 394 of the engagement pin 370. A grease zerk 412 is positioned on the tubular housing 404 and is located substantially midway between the pair of oil grooves 396,400 for communicating a lubricating fluid from an external source through the tubular housing 404 to the engagement pin 370.

INDUSTRIAL APPLICABILITY

During connection of the hydraulic coupler 180 to the bucket 14, as seen in FIG. 8, the tool alignment projections 300 are adapted to be fitted against a respective locating plate 66,70 for aligning the tool mounting edge 346 for reception by the first and second mounting ledges 54. During connection of the hydraulic coupler 180 to the forks, as seen in FIG. 10, the tool alignment projections 300 are adapted to extend through the notched portion 74 of a respective locating plate 66,70 for aligning the tool mounting edge 346 for reception by the first and second mounting ledges 54. Additionally, the tool alignment projections 300 automatically align and center the hydraulic coupler 180 in the tool as the linkage arrangement 94 is racked back. It should be understood that although the relationship of the tool alignment projections 300 with the respective locating plates 66,70 of the bucket and forks (described above) is different, other aspects of the connection of the bucket or forks to the hydraulic coupler 180 is virtually identical.

The front wall portions 282 are then seated against the interface plates 26,30 so that the rectangular apertures 62,312 of the seating ledges 58 and the lower wall portions 296, respectively, are coaxially aligned and the planar surface 308 is flush against the interface plates 26,30. The cylinder rod 366 is moved to the first position which forces the engagement pin 370 simultaneously through the rectangular apertures 62,312 of the seating ledges 58 and the lower wall portions 296 to connect the tool to the machine 11. The engagement pin 370 is wedged into the apertures 62,312 to force the hydraulic coupler 180 upward against the mounting ledges 58 a small amount to tighten the fit between the tool and the hydraulic coupler 180. The lubricating fluid provided to the engagement pin 370 through the external source creates an internal lubrication system which extends along the oil grooves 396,400 and the recess 392 to provide optimal lubrication to the engagement pin 370. The wedge shape of the engagement pin 370 provides an axial load which, under constant hydraulic pressure, maintains a tight coupling even after wearing and ensures proper orientation during engagement. Additionally, the wedged surface of the engagement pin 370 is oriented at approximately ninety degrees to the surface of the lower wall portions 296 and seating ledges 58, as seen more clearly in FIG. 5, for loading the pin in shear to minimize the axial load required for retention. The engagement pin 370 maintains orientation with the lower wall portions 296 and seating ledges 58 through the limited rotation allowance achieved by the location of the set screw 408 within the anti-rotation region 394. The flexibility of the fit between the tool and the hydraulic coupler 180 guarantees proper fit-up and is improved due to the angularity difference between the tool mounting edge 346 and the first and second mounting ledges 54. To release the tool, the operation is reversed through the movement of the cylinder rod 366 to the second position so that a different work implement or tool may be connected to the machine 11.

During the connection process between the hydraulic coupler 180 and the tool or various operational functions, it is very beneficial for the operator of the machine 11 to be able to see the outer sides of the tool and the coupling interface. The separation of the hydraulic coupler 180 into the pair of coupler assemblies 184,188 facilitates ease of assembly to the machine 11 and eliminates the use of a structural torque tube across the width of the hydraulic tool coupler 180. The preclusion of the torque tube enhances the visibility of the operator by creating a viewing space between the coupler assemblies 184,188. Structural integrity is maintained without the torque tube through the incorporation of the pins 230,238 as structural members of the hydraulic coupler 180 due to their unique connection. The clearance space 132 created by the connection of the tilt lever 98 and tilt link 114 further enhances visibility when using the hydraulic coupler 180 by providing a substantially unobstructed view from the machine 11 to the tool.

It is well known that the loads and forces on the box boom lift arm assembly 78 and the tilt linkage arrangement 94 can be extremely severe, making it imperative to increase strength and loading distribution capabilities of the machine 11. The pins 230,238 act to connect the separate pair of coupler assemblies 184,188 in a manner which redirects all the loads to go through the pin joints 260,264 rather than the hydraulic coupler 180 itself creating a substantially uniform loading path from the tool to the machine 11. This substantially straight load path increases the overall strength of the machine 11 without an increase in weight. Additionally, the diminished loading across the hydraulic coupler 180 decreases wear and failure of various internal components, such as the hydraulic cylinder seals (not shown). Furthermore, the hydraulic cylinders 354 are so mounted to achieve a limited three degrees of freedom and necessary clearances so that any side loads that are incurred by the hydraulic coupler 180 will not carry into the hydraulic cylinder seals (not shown) or cylinder rods 366.

The substantially rectangular end portions 246,250 of the pair of pins 230,238 are connected to the vertical plate portions 196 by the bolt assembly 268 to fix the hydraulic coupler 180 in a predetermined position relative thereto. The hydraulic coupler 180 is free to rotate about the fixed position of the upper and lower coupler bosses 162,86 due to the cylindrical central portions 242 of the pair of pins 230,238. Additionally, the movement of the hydraulic coupler 180 corresponds with the relative movement of the tilt linkage 94 and box boom lift arm assembly 78 during operation. The snap ring assembly 269 and bracket assembly 270 are used to substantially prevent any translational movement of each of the pair of coupler assemblies 184,188 on the pair of pins 230,238 and to maintain the pair of pins 230,238 at the proper position within the vertical plates 196.

Other aspects, objects and advantages of this invention can be obtained from a study of the drawings, disclosure and the appended claims.

What is claimed is:

1. A quick release and attachment assembly for coupling a work implement to a construction machine, the construction machine having a frame, a box boom lift arm assembly pivotally connected to the frame at a first end and having a lower coupling pin boss fixedly connected at a second end opposite the first end and a tilt linkage arrangement pivotally connected at a first end to the box boom lift arm and having an upper coupler pin boss fixedly connected at a second end opposite the first end, comprising:

a first attachment means connectable to the work implement, the first attachment means including, a pair of opposed connecting plates and a pair of opposed locating plates fixedly connectable to the work implement, each one of the pair of locating plates positioned substantially perpendicular to and in abutment with the respective first and second ends of each of the pair of connecting plates;

a second attachment means including a body portion and a pair of vertical plates connected to the body portion in a spaced relationship, the body portion having an engagement portion for placement adjacent the connecting plates and a pair of opposing side projections extending from the engagement portion in a predetermined relationship with the pair of locating plates of the first attachment means;

engagement means disposed within the body portion for movement between a first position for connecting the first and second attachment means and a second position for releasing the first and second attachment means; and means for connecting the second attachment means to the upper and lower coupler pin bosses including a pair of pins, each of the pair of pins releasably connected to the pair of vertical plates at first or second end portions thereof for allowing movement of the second attachment means correspondent to the respective movement of the tilt linkage arrangement and the box boom lift arm assembly.

2. The quick release and attachment assembly of claim 1, wherein the body portion of the second attachment means is defined by a pair of coupler assemblies each integrally connected with a respective one of the pair of vertical plates, the coupler assemblies connected at first and second ends to respective first or second ends of the upper and lower coupler pin bosses at a pair of pin joints defined where the pins connect through the vertical plates to establish a spatial relationship between the pair of coupler assemblies.

3. The quick release and attachment assembly of claim 2, wherein each of the pair of coupler assemblies include a housing located thereon and the engagement portion includes a pair of engagement plates each fixedly connected to each of the housings at an inner side portion and a respective one of the pair of side projections extending from each of the engagement plates adjacent an outer side portion opposite the inner side portion.

4. The quick release and attachment assembly of claim 3, wherein the pair of vertical plates each include a pin mounting opening defined at the first and second end portions, the pin mounting openings having a substantially rectangular shape and including a clamp portion extending therefrom and terminating at a pair of spaced flanges defining a coaxial opening therethrough.

5. The quick release and attachment assembly of claim 4, wherein the pair of pins each include a cylindrical central portion extendable through the upper and lower coupler pin bosses and terminating at substantially rectangular end portions fitted within the rectangular shaped openings in each of the pair of vertical plates.

6. The quick release and attachment assembly of claim 5, including a bolt assembly extending through the coaxial openings in each of the spaced flanges for fixing the end portions of the pins within the rectangular shaped openings in each of the pair of vertical plates.

7. The quick release and attachment assembly of claim 5, including a retainer mechanism releasably connected on the end portions of the pins for holding each of the vertical plates on the pair of pins.

8. The quick release and attachment assembly of claim 6, wherein the predetermined relationship of the opposing side projections with the pair of locating plates includes that the opposing side projections are fitted against the pair of locating plates for abutment therewith.

9. The quick release and attachment assembly of claim 6, wherein the predetermined relationship of the opposing side projections with the pair of locating plates includes the opposing side projections extending through notches in the pair of locating plates.

10. The quick release and attachment assembly of claim 1, wherein the pair of vertical plates each include a pin mounting opening defined at the first and second end portions, the pin mounting openings having a substantially rectangular shape and including a clamp portion extending therefrom and terminating at a pair of spaced flanges defining a coaxial opening therethrough.

11. The quick release and attachment assembly of claim 10, wherein the pair of pins each include a cylindrical central portion extendable through the upper and lower coupler pin bosses and terminating at substantially rectangular end portions fitted within the rectangular shaped openings in each of the pair of vertical plates and a bolt assembly extends through the coaxial openings in each of the spaced flanges for fixing the end portions of the pins within the rectangular shaped openings in each of the pair of vertical plates.

12. The quick release and attachment assembly of claim 11, including a retainer mechanism releasably connected on the end portions of the pins for holding the second attachment means on the pair of pins.

13. The quick release and attachment means of claim 3, wherein the engagement means includes a hydraulic cylinder slidably mounted in each of the housings and a wedge shaped pin operatively associated with the hydraulic cylinder, the wedge shaped pin extending through an opening in a lower wall of the engagement plate and terminating in a mating relationship with a respective opening in one of the pair of connecting plate of the first attachment means in the first position.

14. The quick release and attachment means of claim 13, wherein the wedge shaped pin is oriented at ninety degrees to the surface of the lower wall and the one of the connecting plates.

15. A quick release and attachment assembly for coupling a work implement to a construction machine, the construction machine including a first member supporting a lower coupler pin boss and a second member supporting an upper coupler pin boss, comprising:

a pair of non-connected coupler assemblies, each of the pair of coupler assemblies being connectable with respective first or second ends of the upper and lower coupler pin bosses to define a spatial relationship therebetween, the coupler assemblies each having a housing, a vertical plate fixedly connected to the housing at an inner side portion to define therewith a planar front surface, an engagement plate fixedly connected at a rear wall portion to the planar front surface, and a side projection extending from the engagement plate adjacent an outer side portion opposite the inner side portion.

16. The quick release and attachment assembly of claim 15, wherein the vertical plates on the pair of coupler assemblies each include first and second end portions and the planar front surface of the vertical plates diverge inwardly away from the rear wall portion of the respective engagement plate at the first end portion to define a lip with an ledge portion having a predetermined angle.

17. The quick release and attachment assembly of claim 16, wherein each of the housings has an upper edge portion with a pair of shelves extending at an angle from the rear wall portion of the respective engagement plate substantially equal to the predetermined angle of the respective ledge portion of each of the vertical plates and operatively associated therewith to define a joint tool mounting edge, the first end portion of each of the vertical plates extending from the planar front surface to define a clearance space between the first end portion and the engagement plate.

18. The quick release and attachment assembly of claim 15, wherein the connection of the pair of coupler assemblies to the upper and lower coupler pin bosses is at a pair of pin joints having a respective pin which allows synchronized movement of the pair of coupler assemblies in correspondence with the movement of the first and second members.

19. The quick release and attachment assembly of claim 18, wherein the pair of vertical plates each include a pin mounting opening defined at the first and second end portions, the pin mounting openings having a substantially rectangular shape and including a clamp portion extending therefrom and terminating at a pair of spaced flanges defining a coaxial opening therethrough.

20. The quick release and attachment assembly of claim 19, wherein the pair of pins each include a cylindrical central portion extendable through the upper and lower coupler pin bosses and terminating at substantially rectangular end portions fitted within the rectangular shaped openings in each of the pair of vertical plates and a bolt assembly extends through the coaxial openings in each of the spaced flanges for fixing the end portions of the pins within the rectangular shaped openings in each of the pair of vertical plates.

21. The quick release and attachment assembly of claim 20, including a retainer mechanism releasably connected on the end portions of the pins for holding each of the coupler assemblies on the pair of pins.

22. A quick release and attachment assembly for coupling a work implement to a construction machine at remote ends of a first member having a lower coupler pin boss and a second member having an upper coupler pin boss, comprising:

a first attachment means connectable to the work implement;

a second attachment means releasably connected to the first attachment means, the second attachment means including a body portion and a pair of vertical plates connected to the body portion in a spaced relationship wherein the pair of vertical plates each include a pin mounting opening defined at first and second end portions, the pin mounting openings having a substantially rectangular shape and including a clamp portion extending therefrom and terminating at a pair of spaced flanges defining a coaxial opening therethrough;

means for connecting the second attachment means to the upper and lower coupler pin bosses including a pair of pins and a bolt assembly, the pair of pins each include a cylindrical central portion extendable through the upper and lower coupler pin bosses and terminating at substantially rectangular end portions fitted within the rectangular shaped openings in each of the pair of vertical plates and the bolt assembly extends through the coaxial openings in each of the spaced flanges for fixing the end portions of the pins within the rectangular shaped openings in each of the pair of vertical plates;

a retainer mechanism releasably connected on the end portions of the pins for holding the second attachment means on the pair of pins.

23. A quick release and attachment assembly for coupling a work implement to a construction machine, comprising:

a first member having a mounting end connectable with the construction machine and a supporting end opposite the mounting end, the supporting end defining a lower coupler pin boss formed at the supporting end and having first and second ends;

a second member having a mounting end connected with the first member and a supporting end opposite the mounting end, the supporting end defining an upper coupler pin boss integral with the supporting end and having first and second ends corresponding with the first and second ends of the lower coupler pin boss and spaced therefrom; and a pair of non-connected coupler assemblies each having a housing and a vertical plate fixedly connected to the housing, the vertical plate of one of the pair of coupler assemblies connected respectively at the first ends of the lower and upper coupler pin bosses and the vertical plate of the other of the pair of coupler assemblies connected respectively to the second ends of the lower and upper coupler pin bosses to define a spatial relationship between the pair of coupler assemblies extending between the vertical plates, the connection between the pair of coupler assemblies and the lower and upper pin bosses being such that the lower and upper pin bosses extend completely across the spatial relationship between the pair of coupler assemblies for abutment of the respective first and second ends of the lower and upper pin bosses with the respective vertical plates.

24. The quick release and attachment assembly of claim 13, wherein the connection of the pair of coupler assemblies to the upper and lower coupler pin bosses is at a pair of pin joints having a respective pin which allows synchronized movement of the pair of coupler assemblies in correspondence with the movement of the first and second members.

25. The quick release and attachment assembly of claim 23, wherein the vertical plate is fixedly connected to the housing at an inner side portion to define therewith a planar front surface, and including an engagement plate fixedly connected at a rear wall portion to the planer front surface, and a side projection extending from the engagement plate adjacent an outer side portion opposite the inner side portion to define a planar mounting surface.

26. The quick release and attachment assembly of claim 25, wherein the pair of vertical plates each include first and second end portions and a pin mounting opening is defined at the first and second end portions, the pin mounting openings having a substantially rectangular shape and including a clamp portion extending therefrom and terminating at a pair of spaced flanges defining a coaxial opening therethrough.

* * * * *

UNITED STATES PATENT AND TRADEMARK OFFICE

CERTIFICATE OF CORRECTION

PATENT NO. : 6,227,792 B1
DATED : May 8, 2001
INVENTOR(S) : Sherrie R. Baker et al.

It is certified that error appears in the above-identified patent and that said Letters Patent is hereby corrected as shown below:

Claim 24,
Line 43, "claim 13" should be -- claim 23 --.

Signed and Sealed this

Fifth Day of March, 2002

*Attest:*

*Attesting Officer*

JAMES E. ROGAN
*Director of the United States Patent and Trademark Office*